US008870613B2

(12) United States Patent
Watanabe

(10) Patent No.: US 8,870,613 B2
(45) Date of Patent: Oct. 28, 2014

(54) INTAKE DEVICE OF OUTBOARD MOTOR

(75) Inventor: Toshio Watanabe, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 330 days.

(21) Appl. No.: 13/397,888

(22) Filed: Feb. 16, 2012

(65) Prior Publication Data

US 2012/0214370 A1 Aug. 23, 2012

(30) Foreign Application Priority Data

Feb. 17, 2011 (JP) ..... 2011-032296
Feb. 17, 2011 (JP) ..... 2011-032525

(51) Int. Cl.

| | |
|---|---|
| ***B63B 35/73*** | (2006.01) |
| ***F02B 61/04*** | (2006.01) |
| ***F02M 35/16*** | (2006.01) |
| ***B63H 20/32*** | (2006.01) |
| ***F02M 35/10*** | (2006.01) |
| ***F02M 35/08*** | (2006.01) |

(52) U.S. Cl.

CPC ..... *F02M 35/168* (2013.01); *B63H 20/32* (2013.01); *F02M 35/10013* (2013.01); *F02M 35/088* (2013.01)

USPC ..... 440/88 A

(58) Field of Classification Search

CPC ..... B63H 20/00; B63H 20/32; B63H 21/38; B63H 20/001; B63B 2770/00

USPC ..... 440/88 A

See application file for complete search history.

(56) References Cited

U.S. PATENT DOCUMENTS

| | | | | |
|---|---|---|---|---|
| 2,798,470 | A | 7/1957 | Kiekhaefer | |
| 5,340,343 | A * | 8/1994 | Kawamukai et al. | 440/77 |
| 5,492,089 | A * | 2/1996 | Hiraoka et al. | 123/184.47 |
| 5,899,778 | A * | 5/1999 | Hiraoka et al. | 440/88 R |
| 6,062,927 | A * | 5/2000 | Hiraoka et al. | 440/88 R |
| 7,524,224 | B2 | 4/2009 | Ide et al. | |
| 2008/0081523 | A1 | 4/2008 | Ide et al. | |
| 2010/0147257 | A1 | 6/2010 | Yazaki et al. | |
| 2010/0255737 | A1 * | 10/2010 | Inaba | 440/88 A |
| 2013/0019820 | A1 | 1/2013 | Inaba et al. | |

FOREIGN PATENT DOCUMENTS

| | | | |
|---|---|---|---|
| JP | 2007-8416 | A | 1/2007 |
| JP | 2008-88881 | A | 4/2008 |

OTHER PUBLICATIONS

Extended European Search Report, dated Oct. 18, 2013, which issued during the prosecution of European Patent Application No. 12155744.1, which corresponds to the present application.

* cited by examiner

*Primary Examiner* — Daniel V Venne
(74) *Attorney, Agent, or Firm* — Troutman Sanders LLP

(57) ABSTRACT

In an intake device of an outboard motor that supplies outside air taken in through an outside air intake port to a throttle body to get the outside air sucked, an intake chamber communicating with the outside air intake port and the throttle body is isolated from an engine room, and is disposed above an engine unit in the engine room.

9 Claims, 7 Drawing Sheets

INTAKE DEVICE OF OUTBOARD MOTOR

CROSS-REFERENCE TO RELATED APPLICATIONS

This application is based upon and claims the benefit of priority of the prior Japanese Patent Application No. 2011-032296, filed on Feb. 17, 2011, and the Japanese Patent Application No. 2011-032525, filed on Feb. 17, 2011 the entire contents of which are incorporated herein by reference.

BACKGROUND OF THE INVENTION

1. Field of the Invention

The present invention relates to an intake device of an outboard motor. More specifically, the present invention relates to an intake device supplying combustion air to an engine mounted in an outboard motor.

2. Description of the Related Art

As for an outboard motor provided with an internal combustion engine housed in an engine room formed of an engine cover, there have been known various techniques aimed at preventing water mixed in combustion air from intruding into a combustion chamber. Particularly, in an internal combustion engine mounted in a propulsion unit of an outboard motor or the like, a water intrusion prevention function that is reduced in size and excellent is required.

Conventionally, for example, in an outboard motor disclosed in Patent Documents 1, 2, and the like, for the purpose of achieving improvement of an effect of preventing water intrusion into a combustion chamber in an internal combustion engine and intake air filling efficiency, and so on, it is designed such that when water is mixed in combustion air that has flowed in through an intake port in an intake device, the water is separated from the combustion air in an inversion passage by a centrifugal force.

Concretely, in an outside air intake structure of an outboard motor having an outside air intake port provided at the rear of an upper portion of an engine cover covering an engine, there are included air intake ducts fixedly provided on an engine side and air intake guides that are brought into a state of being connected to the air intake ducts when an engine cover is attached to the outboard motor and guide outside air taken in through the outside air intake port to the air intake ducts, and it is constituted such that the outside air taken in through the outside air intake port is guided to a lower portion in the engine cover through the air intake guides and the air intake ducts. Further, it is suppressed that heated air flows into an engine room through an intake port of an intake passage, and a rise in temperature of the combustion air is suppressed, resulting in that improvement of filling efficiency is achieved.

[Patent Document 1] Japanese Laid-open Patent Publication No. 2007-8416

[Patent Document 2] Japanese Laid-open Patent Publication No. 2008-88881

However, the air taken into the engine cover flows in the immediate vicinity of the high-temperature engine to be warmed up, and then is sucked into a throttle body to be supplied to a combustion chamber. Filling efficiency (volumetric efficiency) of the high-temperature sucked air is poor, and problems that the high-temperature sucked air affects combustion efficiency, and further fuel efficiency, and so on are caused.

Furthermore, as disclosed in Patent Document 1, in the outboard motor of this type, normally the outside air intake port in an outside air intake space formed by an exterior cover opens rearward, namely in a direction opposite to a forward traveling direction of the outboard motor. In such an exterior cover structure, as for taking in air in particular, air is taken in in a manner to go against the flow of air flowing outside the outboard motor. In such a way of taking in intake air, intake resistance is caused to deteriorate intake efficiency, resulting in that engine output is reduced.

On the other hand, in order to improve the intake efficiency, as far as the above point is concerned, it is possible to provide the outside air intake port to be directed forward. However, when the outside air intake port is disposed to be directed forward as above, water splashes and so on get in through the outside air intake port while a craft is traveling, and thus it is substantially impossible to fabricate such an intake structure.

SUMMARY OF THE INVENTION

In view of such a situation, the present invention has an object to provide an intake device of an outboard motor, which achieves excellent intake performance while preventing water intrusion.

An intake device of an outboard motor according to the present invention being an intake device of an outboard motor having: an engine; an engine cover covering the engine; and an engine room formed inside the engine cover, the intake device of the outboard motor includes: an upper cover attached to an upper surface of the engine cover; an outside air intake port formed in the upper cover; a throttle body through which outside air taken in through the outside air intake port is supplied to the engine; and an intake chamber formed between the upper cover and the engine cover and communicating with the outside air intake port and an upstream end of the throttle body, in which the intake chamber is isolated from the engine room.

The intake device of the outboard motor further includes: a separator that is a separator gas/liquid separating the outside air taken in through the outside air intake port and is provided inside the intake chamber, in which the separator has a skirt portion formed by at least a front portion of the separator being extended downward.

It is characterized in that a lower end of the skirt portion is disposed lower than an intake communication port of the throttle body.

It is characterized in that a lower end of the outside air intake port is disposed higher than the lower end of the skirt portion.

The intake device of the outboard motor further includes: a plate isolating the intake chamber from the engine room, in which the intake chamber is isolated from the engine room by the plate.

The intake device of the outboard motor of the present invention being an intake device of an outboard motor having: an engine; an engine cover covering the engine; and an engine room formed inside the engine cover, the outboard motor includes: an upper cover attached to an upper surface of the engine cover and having an outside air intake port; a plate lying between the engine cover and the upper cover; an intake chamber formed between the upper cover and the plate and isolated from the engine room; and a throttle body through which outside air taken into the intake chamber through the outside air intake port is supplied to the engine.

The intake device of the outboard motor further includes: a drain path that communicates with an internal space and external space of the intake chamber and through which water that has intruded into the internal space of the intake chamber is allowed to be drained to the external space of the intake chamber.

It is characterized in that the plate is provided with a bottom wall including an upper area and a lower area, and a throttle body coupling pipe through which outside air inside the intake chamber is supplied to the throttle body communicates with the upper area of the bottom wall, and the drain path communicates with the lower area of the bottom wall.

It is characterized in that the drain path communicates with the lower area of the bottom wall positioned at a lowest portion of the intake chamber in a state where tilt up of the outboard motor is performed and is not performed.

It is characterized in that the drain path is provided with a backflow prevention mechanism preventing water from flowing back into the internal space of the intake chamber from the external space of the intake chamber.

It is characterized in that the backflow prevention mechanism is a one-way valve.

It is characterized in that the backflow prevention mechanism is an S-shaped pipe.

DETAILED DESCRIPTION OF THE PREFERRED EMBODIMENTS

Hereinafter, a preferred embodiment of an intake device 4 of an outboard motor according to the present invention will be explained based on the drawings.

Figure 1:
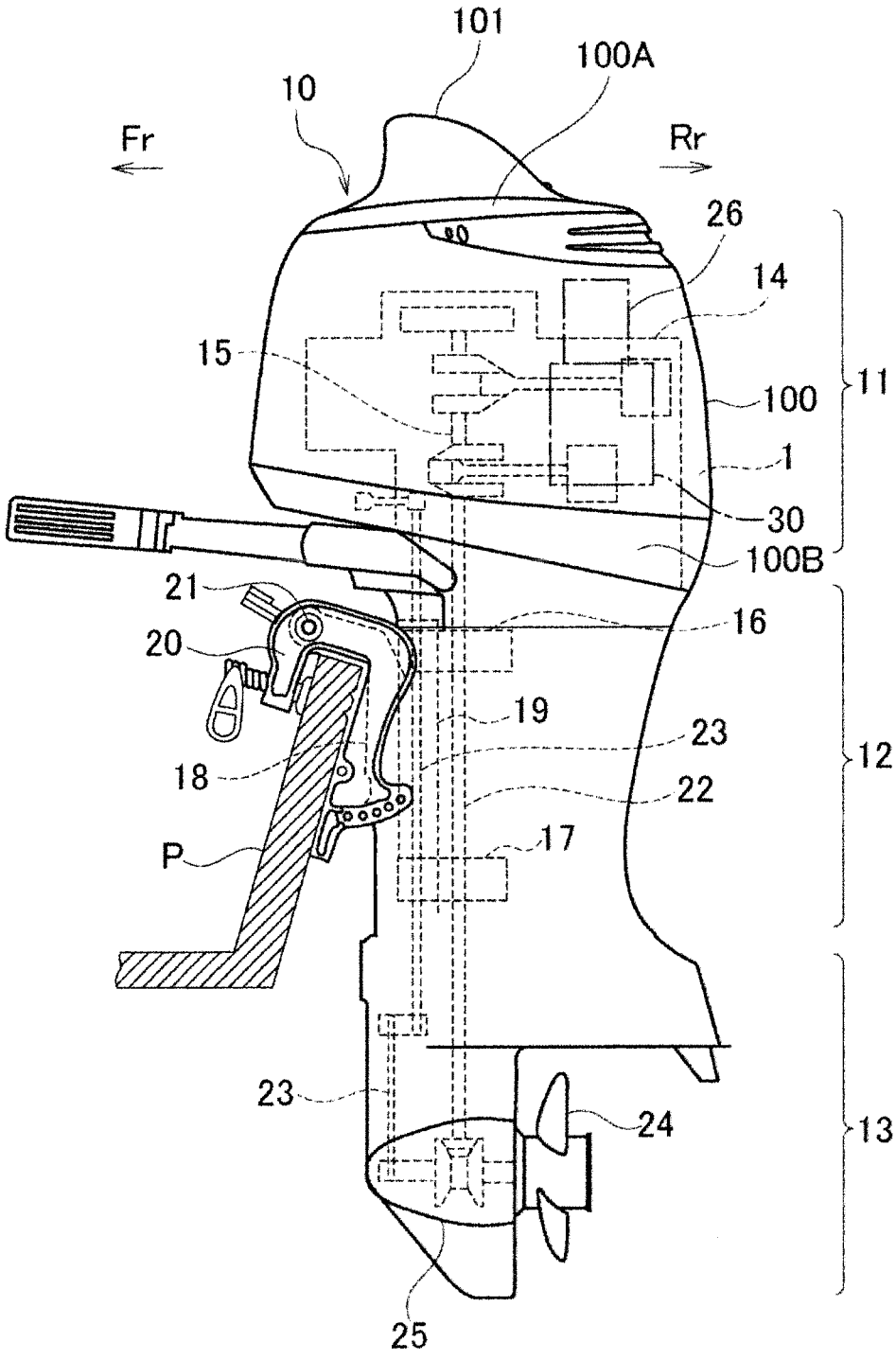
FIG. 1 is a left side view illustrating an example of the entire schematic structure of an outboard motor according to an embodiment of the present invention.

FIG. 1 is a left side view illustrating an example of a schematic structure of an outboard motor 10 according to an embodiment of the present invention. In this case, as illustrated in FIG. 1, a front portion side of the outboard motor 10 is fixed to a stern board P of a hull. Incidentally, in the respective drawings in the following explanation, the front of the outboard motor 10 is indicated by an arrow Fr, and the rear of the outboard motor 10 is indicated by an arrow Rr, and further the lateral right side of the outboard motor 10 is indicated by an arrow R, and the lateral left side of the outboard motor 10 is indicated by an arrow L respectively as necessary.

In the entire structure of the outboard motor 10, an engine unit 11, a mid unit 12, and a lower unit 13 are sequentially disposed and structured from top to bottom. In the engine unit 11, an engine 14 is vertically mounted and supported via an engine base such that a crankshaft 15 of the engine 14 is directed in a vertical direction. Incidentally, as the engine 14, a multicylinder engine such as a V-type six-cylinder engine, for example, can be employed. The mid unit 12 is supported via an upper mount 16 and a lower mount 17 so as to be integrally turnable around a supported shaft 19 set on a swivel bracket 18. On both right and left sides of the swivel bracket 18, a clamp bracket 20 is set, and the outboard motor 10 is fixed to the stern board P of the hull via the above clamp bracket 20. The clamp bracket 20 is supported to be turnable in an upward and downward direction around a tilt shaft 21 set in a right and left direction.

In the mid unit 12, a drive shaft 22 coupled to a lower end portion of the crankshaft 15 is disposed to pass through therein in the upward and downward direction, and a driving force of the above drive shaft 22 is designed to be transmitted to a later-described propeller shaft in a gear case of the lower unit 13. In front of the drive shaft 22, a shift rod 23 for performing switching of forward traveling or reverse traveling, or the like is disposed to be parallel to the upward and downward direction. Incidentally, the mid unit 12 has a drive shaft housing housing the drive shaft 22. Further, in the mid unit 12, there is provided an oil pan in which oil for lubricating the engine unit 11 is stored.

The lower unit 13 has a gear case 25 including a plurality of gears rotary driving a propeller 24 by the driving force of the drive shaft 22, and so on. A gear attached to the drive shaft 22 extending downward from the mid unit 12 engages with the gears in the gear case 25, thereby rotating the propeller 24 finally, and by an action of the shift rod 23, power transmission paths of a gear device in the gear case 25 are switched, namely are shifted.

Figure 2:
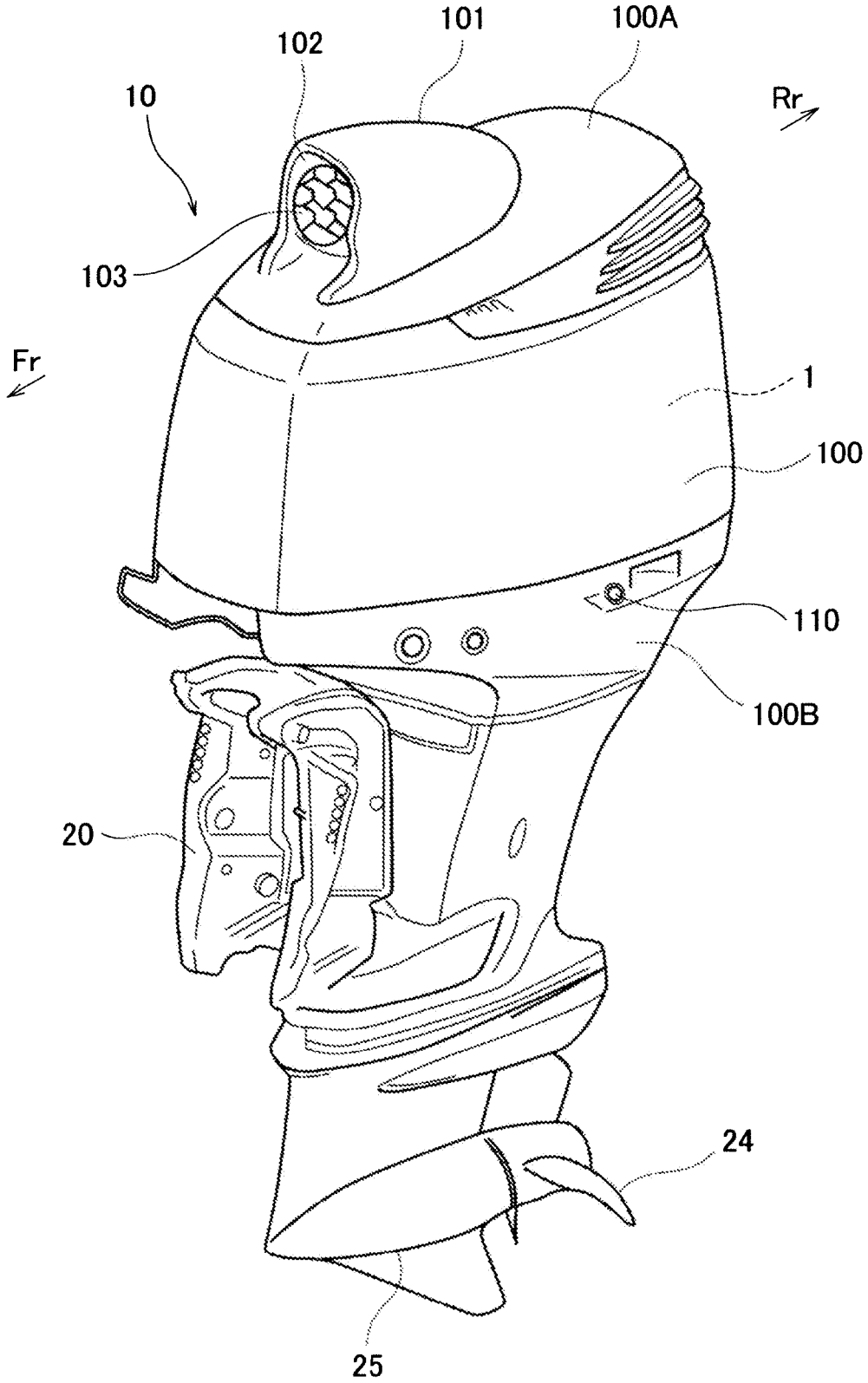
FIG. 2 is a perspective view illustrating an example of an appearance structure of the outboard motor according to the embodiment of the present invention.

The engine unit 11 is housed in an engine room 1 formed of an engine cover 100 being an exterior part. The inside of the engine room 1 covered with the engine cover 100 has a sealed structure, and is cut off from outside air substantially. To an upper surface of the engine cover 100, an upper cover 100A covering the vicinity of an upper portion of the engine cover 100 is attached. On the other hand, to a lower portion of the engine cover 100, a lower cover 100B covering the periphery of the lower portion of the engine cover 100 is attached. Then, the engine cover 100, the upper cover 100A, and the lower cover 100B are integrally coupled to form an appearance form of a substantially oval shape, a lemon shape, or the like as a whole as illustrated in FIG. 2.

Here, in this example, in the engine unit 11 having the engine 14 having V-type six cylinders, cylinder blocks corresponding to both sides of a V shape are disposed so as to fan out rearward from the crankshaft 15 disposed to correspond to a valley of the V shape. A throttle body 30 supplying an air-fuel mixture to each of the cylinders of the cylinder blocks is disposed to be sandwiched between the cylinder blocks disposed in a V-shape. Further, a throttle body coupling pipe or tube 26, (which will be simply described as a throttle body coupling pipe, below), that is connected to an intake port 27 of the throttle body 30 (see FIG. 7) and through which intake air is supplied to the throttle body 30 opens upward in the vicinity of a lower side of the upper cover 100A. The above throttle body coupling pipe 26 is disposed near a rear end of the engine room 1.

Figure 3:
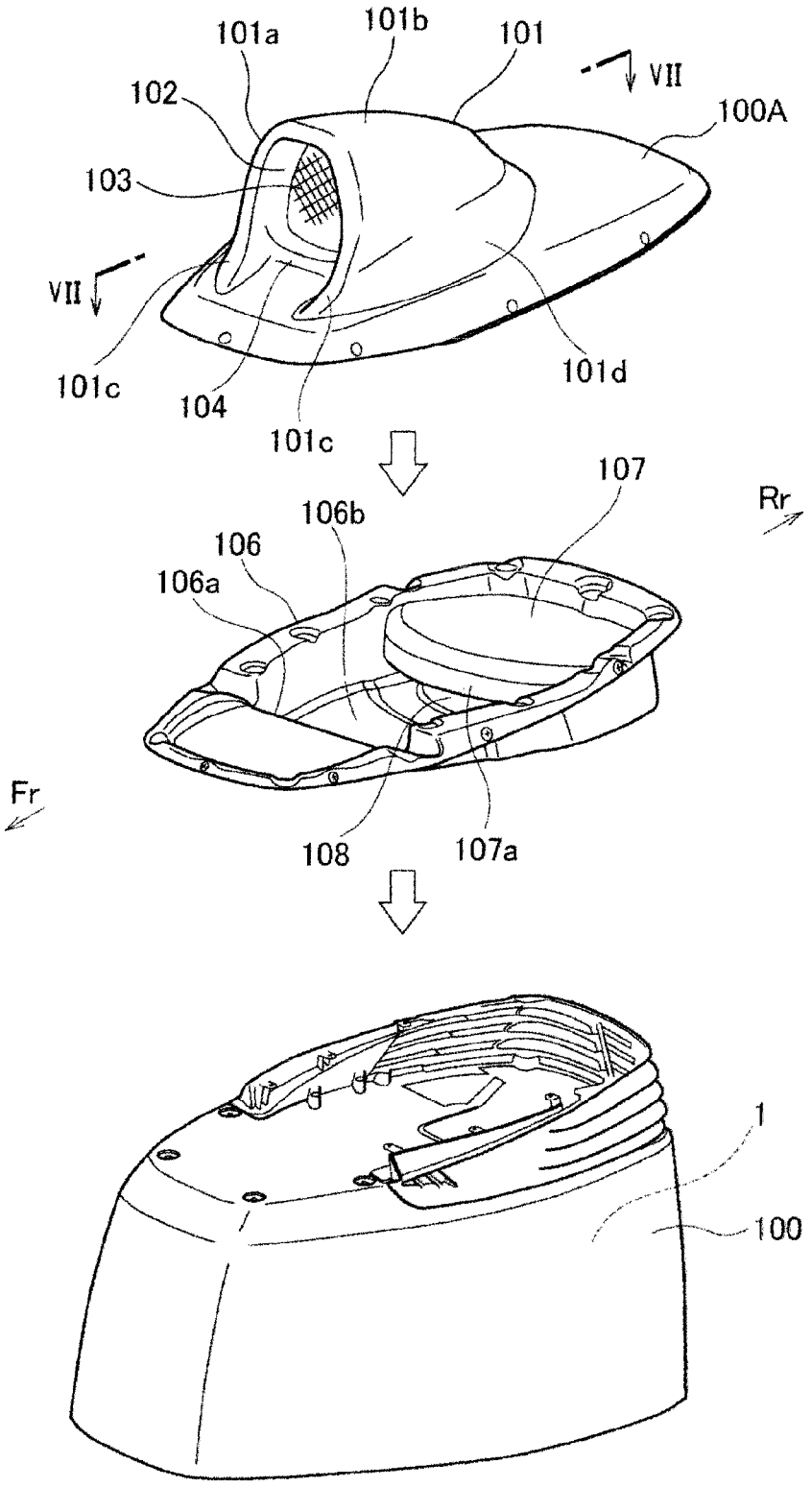
FIG. 3 is an exploded perspective view of the vicinity of an engine cover of the outboard motor according to the embodiment of the present invention.
Figure 4:
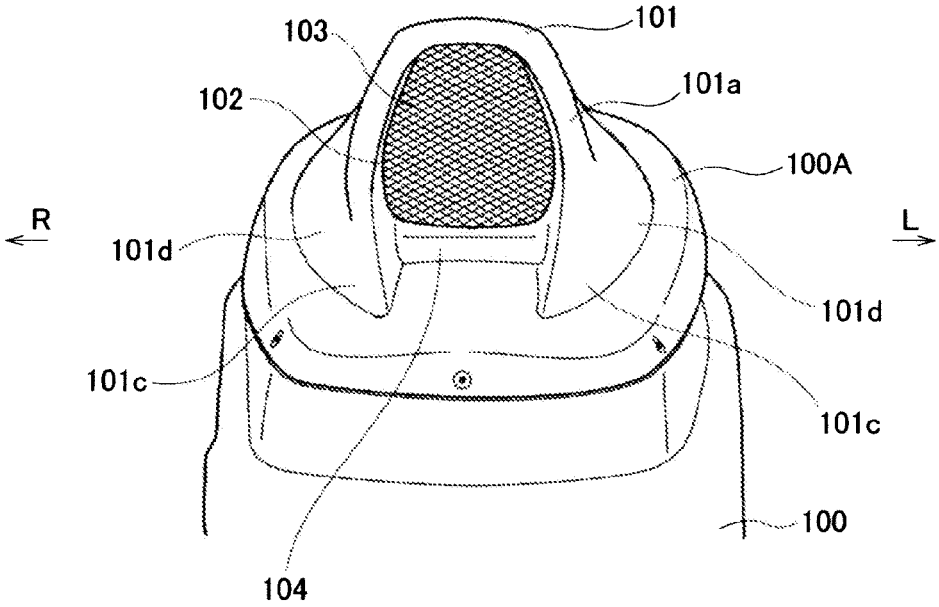
FIG. 4 is a front view of the vicinity of an upper engine cover according to the embodiment of the present invention.
Figure 5:
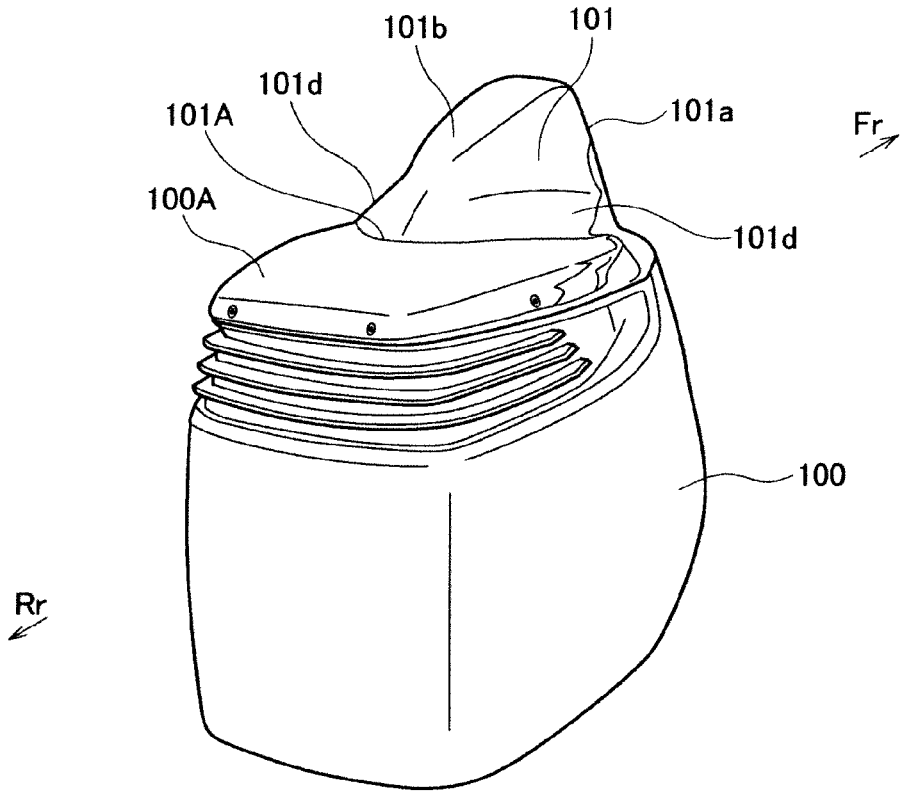
FIG. 5 is a rear perspective view of the vicinity of the upper engine cover according to the embodiment of the present invention.

FIG. 3 to FIG. 5 each illustrates the vicinity of the upper cover 100A. The upper cover 100A, in plan view, exhibits approximately an oval shape or an ellipse shape that is long in a forward and backward direction, and is gently curved to be convex upward as a whole. As a material to form the above upper cover 100A, for example, carbon fiber reinforced plastics (CFRP; Carbon Fiber Reinforced Plastics) or the like are preferred. Then, inside the upper cover 100A, the intake device 4 (see FIG. 7) isolated from the engine room 1 as will be described later is constituted.

A bulging portion 101 provided to bulge upward is provided near the front on an upper surface of the upper cover 100A. As an overall form of the above bulging portion 101, in side view, a front end edge of the bulging portion 101 is formed linearly in the substantially upward and downward direction, and on the front end edge, a later-described surrounding wall 101*a* formed to rise substantially vertically to the upper surface of the upper cover 100A is provided.

In side view, similarly, from a front end of the surrounding wall 101*a* to the rear, there is provided a back portion 101*b* that maintains a moderately upward convex curved shape and is gently inclined rearward and downward so as to exhibit a stream line shape to then stretch to the upper surface of the upper cover 100A. Further, from the front end edge formed substantially linearly in the right and left direction (a width direction) to the rear, the bulging portion 101, in top view, maintains curved shapes to be moderately convex in the right and left direction and meets the upper surface of the upper cover 100A so that a width of the bulging portion 101 is narrowed gradually.

In a front portion of the bulging portion 101 of the upper cover 100A, an outside air intake port 102 opening to be directed forward is provided. Here, being directed forward means that the outside air intake port 102 opens in a direction perpendicular to the right and left direction, and the front is horizontal to the right and left direction, and based on the above condition, directions to moderately incline relative to the upward and downward direction and the right and left direction are also included. The above outside air intake port 102 is made circular, for example, and is provided at the back of a recess recessed from the front end of the surrounding wall 101*a* to the rear. Incidentally, a moderate mesh strainer of filter 103 is fitted to the outside air intake port 102 to prevent intrusion of outside foreign matters. The surrounding wall 101*a* formed to extend forward from one portion of the bulging portion 101 is formed on the periphery of the outside air intake port 102, and the outside air intake port 102 is disposed to be surrounded by the above surrounding wall 101*a*.

Lower portions of the surrounding wall 101*a*, in side view, are each curved concavely moderately to extend further forward, and thereby joined portions 101*c* to the upper surface of the upper cover 100A are formed. The right and left paired joined portions 101*c*, in top view, each maintain a shape curved convexly moderately in the right and left direction and extend forward so as to make a width therebetween narrow slightly. Incidentally, besides the case where the width is narrowed as above, the joined portions 101*c* may also be formed to be substantially parallel to each other practically, or to slightly fan out forward.

Further, both right and left outer sides stretching down from the back portion 101*b* are formed as a projecting portion 101*d* formed to project convexly outward so as to surround the periphery of the back portion 101*b*. The above projecting portion 101*d* is formed so as to smoothly continue to the joined portions 101*c* formed at the front.

As above, the upper cover 100A and the bulging portion 101 on the upper surface of the upper cover 100A are generally formed of an outward convex curved surface or curved line having an appropriate radius (R) to have a rounded form as a whole. That is, the upper cover 100A and the bulging portion 101 on the upper surface of the upper cover 100A have an exterior form substantially having no acute angle portions to suppress air resistance as much as possible. Further, the inside of the bulging portion 101 has a hollow structure substantially corresponding to such an exterior form, and the inside and outside of the bulging portion 101 communicate with each other via the outside air intake port 102.

Figure 7:
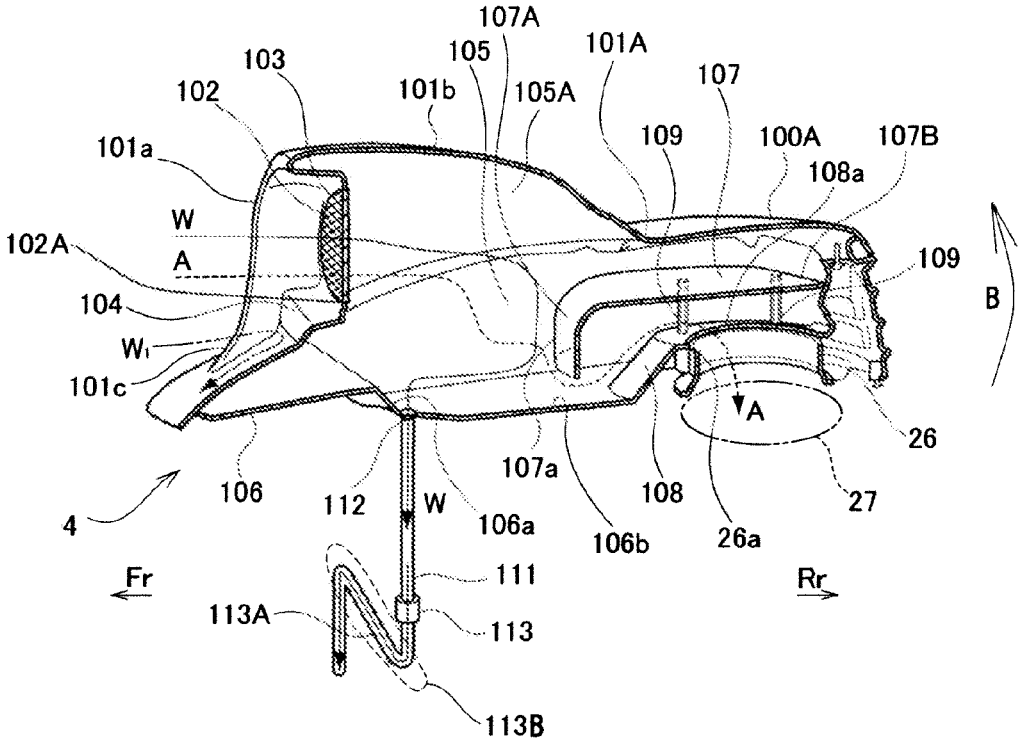
FIG. 7 is a cross-sectional view taken along a line VII-VII in FIG. 3.

In the above-described case, further, as illustrated also in FIG. 7 and the like, there is formed a step portion 104 formed by the upper surface of the upper cover 100A being recessed, in front of a lower edge of the outside air intake port 102. The upper surface of the upper cover 100A extending forward from the above step portion 104 is formed into an inclined surface gently inclined forward and downward.

Further, the surrounding wall 101*a* extends forward from the outside air intake port 102 as described previously, and has a cross-sectional shape whose inner side (inner surface) is linear, namely is a straight surface such as a cylindrical peripheral surface parallel to a cylinder axis. Further, the cross-sectional shape of the surrounding wall 101*a*, of which an outer side (outer surface) is curved convexly outward moderately, is a shape approximate to, for example, an airfoil cross-sectional shape as a whole.

Figure 6:
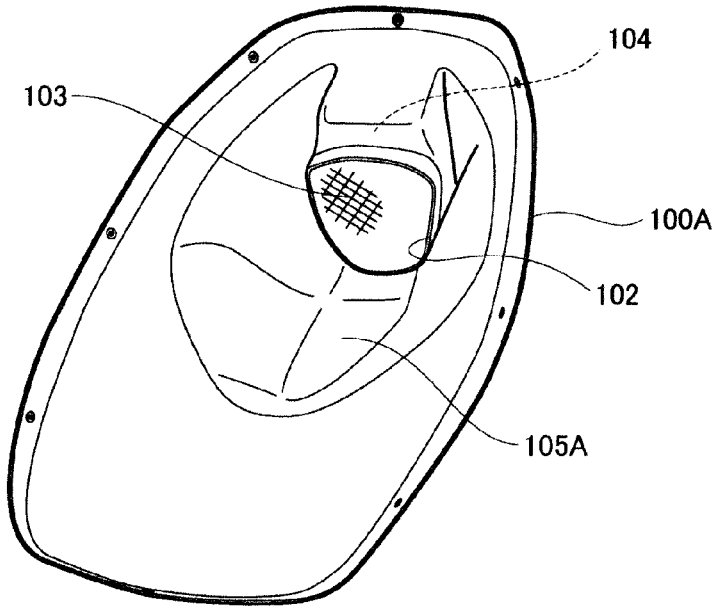
FIG. 6 is a perspective view illustrating an inner side of the upper engine cover according to the embodiment of the present invention.
Figure 8:
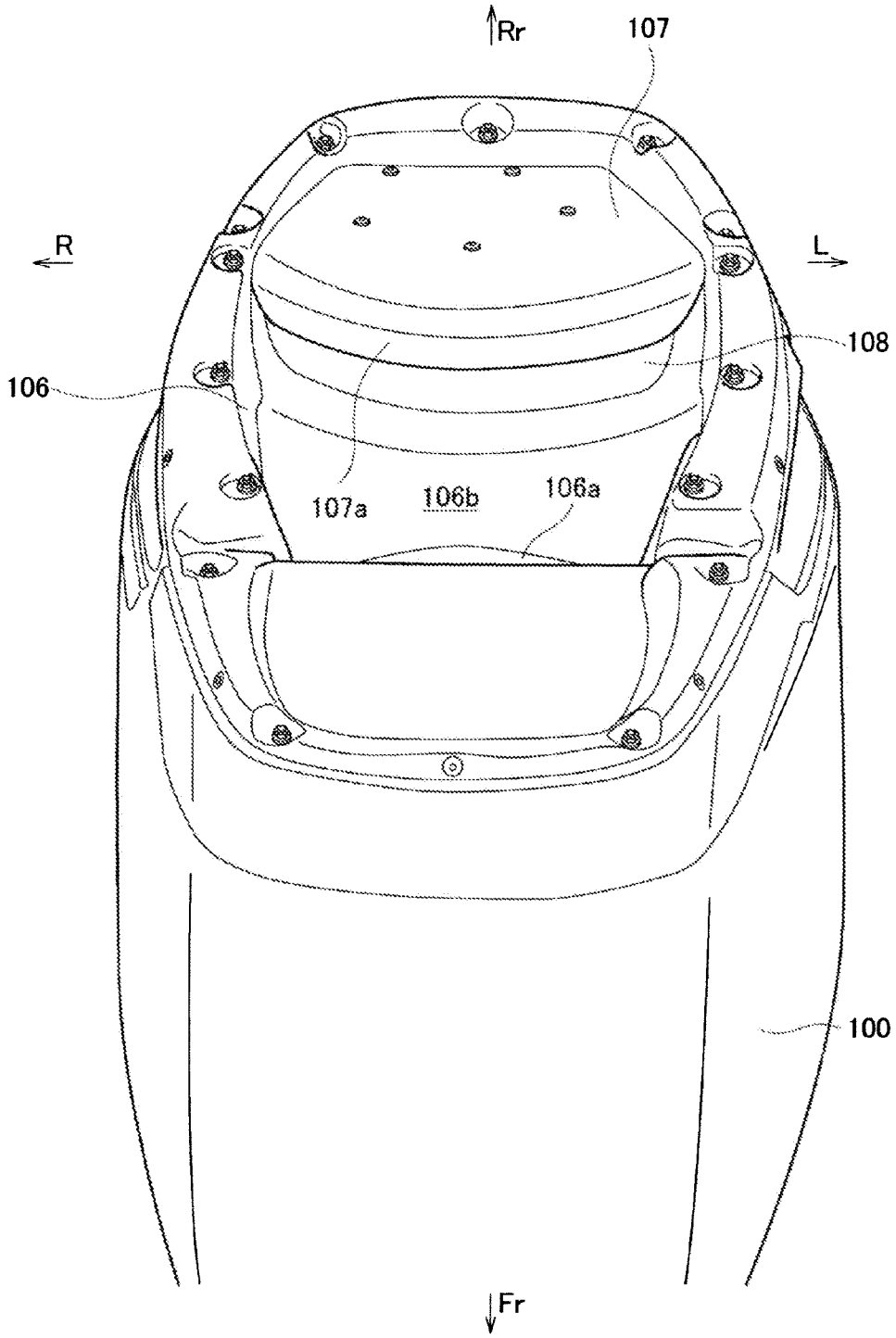
FIG. 8 is a perspective view illustrating the vicinity of an under plate and a separator on the engine cover according to the embodiment of the present invention.

Next, the internal constitution of the upper cover 100A will be explained. First, as illustrated in FIG. 6, inside the upper cover 100A, there is provided an inner space 105A formed of the bulging portion 101 provided to bulge outward as described previously. Further, the upper cover 100A, along an outer circumferential edge thereof, is closed with an under plate 106 illustrated in FIG. 7, and an intake chamber 105 is formed between the upper cover 100A and the under plate 106, including the inner space 105A inside the bulging portion 101. Note that the above intake chamber 105 has an effect of converting dynamic pressure of air taken in through the outside air intake port 102 to static pressure. Here, the engine cover 100 has an open structure in which an upper end of the engine cover 100 is open. The under plate 106 is attached to an upper end portion of the engine cover 100, as illustrated in FIG. 8, and by providing the under plate 106, an intake chamber 105 side and an engine room 1 side formed in the engine cover 100 are substantially isolated. That is, the engine room 1 is formed of the engine cover 100 substantially. As above, the intake chamber 105 is formed between the upper cover 100A and the engine cover 100. Then, the intake chamber 105 is isolated from the engine room 1 by the under plate 106. That is, the under plate 106 constitutes a bottom wall of the intake chamber 105. As illustrated in FIG. 7, in particular, the outside air intake port 102 is positioned at the front of the intake chamber 105, and the throttle body 30 is positioned at the rear of the intake chamber 105. As above, the intake chamber 105 communicates with the outside air intake port 102 and an upstream end of the throttle body 30.

Similarly to the upper cover 100A, the under plate 106, in plan view, is formed into approximately an oval shape that is long in the forward and backward direction, and further has a substantially plate shape or a flat-bottomed shallow pan shape, as a whole. The under plate 106 is formed such that the depth of the plate shape is gradually increased rearward approximately, and steps down via a step portion 106*a* and has a bottomed structure having a bottom portion 106*b* to be an inclined plane inclined forward and downward. Further, as described previously, the throttle body coupling pipe 26 is disposed near the rear end of the engine room. A separator 107 is fixed and supported to and on the under plate 106 at the rear of the intake chamber 105 and above the throttle body coupling pipe 26. The above separator 107 has a function of preventing water from intruding into the throttle body coupling pipe 6 opening upward (=a gas/liquid separation function). A skirt portion 107*a* extending downward is formed at the front (concretely, a front end edge) of the separator 107. The above skirt portion 107*a*, in plan view, is curved in, for example, an arc shape or the like so as to be convex forward, and the separator 107 positioned behind the skirt portion 107*a* comes into close contact with an inner peripheral surface of the under plate 1.

Figure 9:
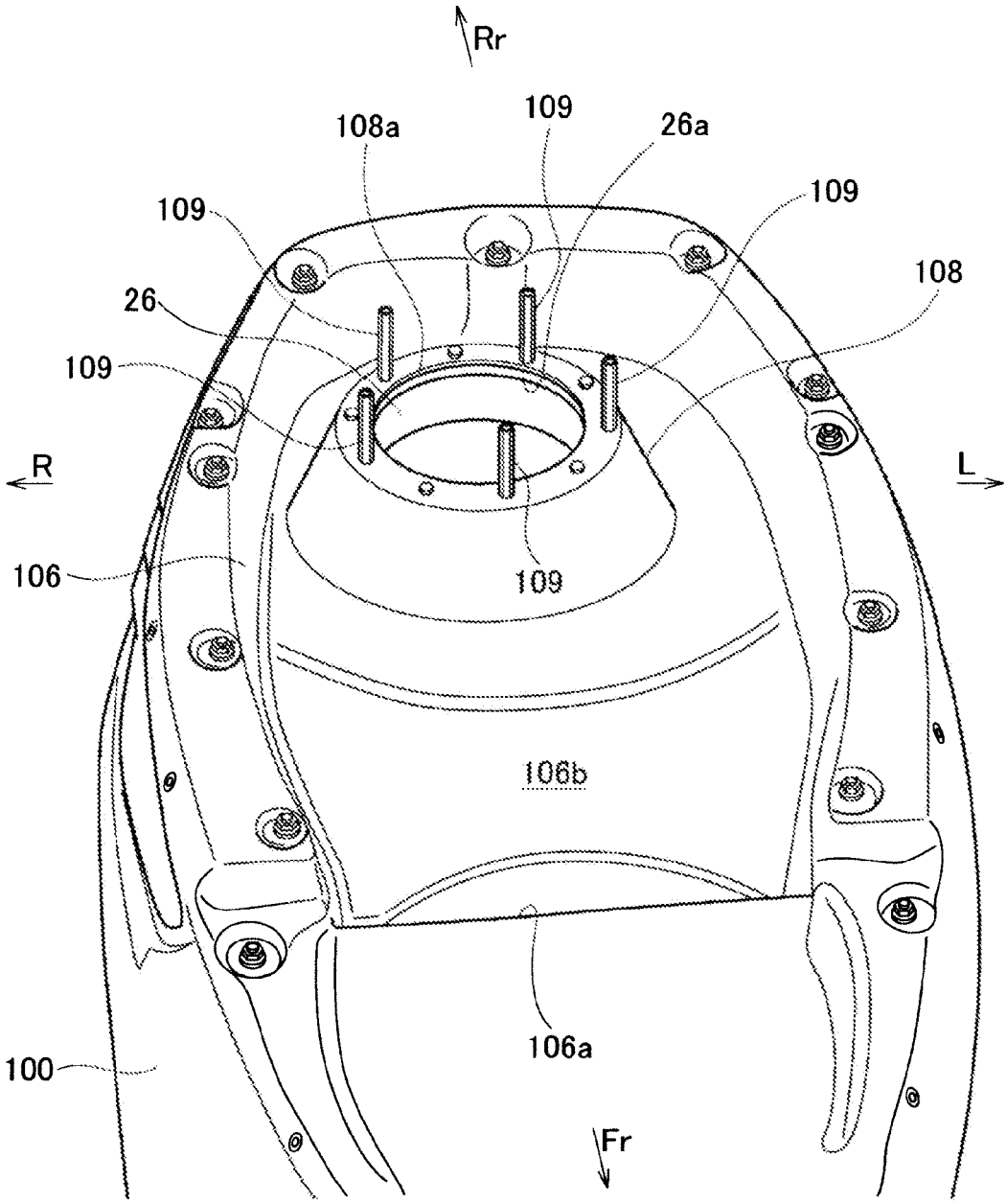
FIG. 9 is a perspective view illustrating the vicinity of the under plate on the engine cover according to the embodiment of the present invention, from which the separator is removed.

FIG. 9 illustrates a state where the separator 107 is removed from the under plate 106. On the bottom portion 106*b* of the under plate 106, there is provided a guide base portion 108 for guiding air flow that is provided projectingly from the bottom portion 106*b* so as to surround the circumference of an upper end opening portion 26*a* of the throttle body coupling pipe 26. The above guide base portion 108 is formed into a truncated cone shape, for example, and an opening 108*a* disposed so as to be consistent with the upper end opening portion 26*a* of the throttle body coupling pipe 26 is opened on top of the guide base portion 108. A circumferential surface of the guide base portion 108 is formed as an inclined surface 108*b* inclined toward the opening 108*a*.

Further, on a circumferential edge of the opening 108*a* of the guide base portion 108, a plurality of connecting rods 109 for supporting the separator 107 are provided upright. The separator 107 supported on the connecting rods 109 is disposed above the opening 108*a* of the guide base portion 108 substantially in parallel with the bottom portion 106*b* of the under plate 106, as illustrated in FIG. 7 and the like. In the above case, as illustrated in FIG. 7, a lower end of the skirt portion 107*a* of the separator 107 is positioned lower than the opening 108*a* of the guide base portion 108 and the upper end opening portion 26*a* of the throttle body coupling pipe 26 (namely, an intake communication port of the throttle body 30). Further, as illustrated in FIG. 7, a lower edge of the outside air intake port 102 is disposed to be positioned higher than the lower end of the skirt portion 107*a* of the separator 107.

Further, there is provided a drain path communicating with the space inside the upper cover 100A, which is isolated from the engine room 1 side via the under plate 106, namely communicating with the inside and outside of the intake chamber 105.

Concretely, as illustrated in FIG. 7, there is provided a drain pipe or tube 111 (that will be simply described as a drain pipe, below) as the drain path provided between the bottom portion 106*b* of the under plate 106 and an opening portion 110 (see FIG. 2) provided in the lower cover 100B, and water is designed to be drained through the above drain pipe 111. That is, the drain pipe 111 communicates with an internal space and external space of the intake chamber 105, and through the drain pipe 111, water that has intruded into the internal space of the intake chamber 105 is allowed to be drained to the external space of the intake chamber 105. In the above case, in the bottom portion 106*b* of the under plate 106, there is provided a drain hole 112 to which an upper end of the drain pipe 111 is connected. The above drain hole 112 is provided at a position that always becomes a lowest place in the bottom portion 106*b* substantially, namely at a position that allows water to be drained through the drain hole 112 when tilting of the outboard motor 10 is performed. Concretely, the bottom portion 106*b* is the inclined plane inclined forward and downward, and the drain hole 112 is formed in the vicinity of a front end portion of the bottom portion 106*b*. More concretely, an appropriate place of the bottom portion 106*b* positioned immediately close to the step portion 106*a* of the under plate 106 is preferred.

Then, the intake port 27 of the throttle body 30 is positioned at the rear of the intake chamber 105 and the drain hole 112 is provided at the front of the intake chamber 105, so that inside the intake chamber 105, the intake port 27 of the throttle body 30 and the drain hole 112 of the drain pipe 111 are formed to be widely spaced therebetween in the forward and backward direction. Further, as illustrated in FIG. 7, in particular, the under plate 106 forms the bottom wall of the intake chamber 105. The guide base portion 108 provided to project upward from the bottom portion 106*b* is formed on the under plate 106 (namely, the bottom wall of the intake chamber 105), and the upper end opening portion 26*a* of the throttle body coupling pipe 26 is positioned at the opening 108*a* formed in the above guide base portion 108. As above, the drain hole 112 of the drain pipe 111 is formed at the position lower than the upper end opening portion 26*a* of the throttle body coupling pipe 26 (namely, an intake communication port of the throttle body 30). In other words, the throttle body coupling pipe 26 through which outside air is supplied to the throttle body 30 is formed in an upper area of the bottom wall of the intake chamber 105, and the drain hole 112 communicating with the drain pipe 111 is formed in a lower area of the bottom wall of the intake chamber 105.

Further, when tilt up (or trim up) of the outboard motor 10 is performed, as indicated by an arrow B in FIG. 7, a rear portion side of the outboard motor 10 is raised and the outboard motor 10 is set in a forward tilting posture. The drain hole 112 is formed at the front of the bottom portion 106*b*, so that even in the case when tilt up of the outboard motor 10 is performed, the drain hole 112 (namely an end portion, of the drain path, on an inside side of the intake chamber 105) is always positioned at the lowest portion of the bottom portion 106*b*. As above, the drain hole 112 is formed so as to be positioned at the lowest portion of the bottom portion 106*b* regardless of the posture of the outboard motor 10. As described above, the under plate 106 forms the bottom wall of the intake chamber 105. For this reason, in other words, the drain hole 112 is formed at the lowest position of the bottom wall of the intake chamber 105. Thus, it is possible to prevent water from staying on the bottom portion 106*b*.

There is provided a backflow prevention mechanism preventing backflow of water to be drained, along the drain path formed of the drain pipe 111. As the backflow prevention mechanism, as illustrated in FIG. 7, there is provided a one-way valve 113 allowing water to be drained to flow only in a draining direction indicated by an arrow W. Incidentally, the constitution of the above one-way valve 113 is not limited, and it is only necessary that the one-way valve 113 has a constitution allowing liquid to flow only in one direction. Thus, well-known various one-way valves can be applied. Further, the backflow prevention mechanism may also be constituted that an S-shaped pipe 113B having a bent portion 113A made by the drain pipe 111 being curved or bent in an S-shape is applied. The bent portion 113A of the S-shaped pipe 113B becomes an obstacle to water flow, so that backflow of water through the drain pipe 111 can be prevented or suppressed. Further, as for the water that has flowed back in the drain pipe 111, its force is attenuated in the bent portion 113A of the S-shaped pipe 113B, so that it is possible to prevent the water from flowing back into the internal space of the intake chamber 105. Furthermore, in the case when air containing water has flowed back in the drain pipe 111, the water contained in the air strikes against an inner surface of the bent portion 113A of the S-shaped pipe 113B, and thereby the air and the water are separated. Thus, it is possible to prevent the water from flowing back into the internal space of the intake chamber 105. Incidentally, the backflow prevention mechanism may be constituted to be provided with one of the one-way valve 113 and the S-shaped pipe 113B, or may also be constituted to be provided with both the one-way valve 113 and the S-shaped pipe 113B.

Here, a basic operation of the outboard motor 10 constituted as described above will be explained schematically. When the engine 14 of the engine unit 11 starts, the drive shaft 22 coupled to the lower end portion of the crankshaft 15 starts to rotate.

By appropriately manipulating a shift mechanism, a driving force of the drive shaft 22 is transmitted to the propeller shaft in the lower unit 13, and thereby the propeller 24 rotates to allow the outboard motor 10 to travel forward.

Particularly, as for the flow of combustion air to be supplied to the engine 14, when a craft having the outboard motor 10 mounted thereon travels, first, outside air flows in through the outside air intake port 102 provided in the bulging portion 101 of the upper cover 100A. The air taken in through the outside air intake port 102 passes into the intake chamber 105 through the inner space 105A inside the bulging portion 101, and, as indicated by a dotted line arrow A in FIG. 7, passes through under the skirt portion 107*a* of the separator 107 to then be supplied to the throttle body 30 through the opening 108*a* of the guide base portion 108 and the upper end opening portion 26*a* of the throttle body coupling pipe 26.

Incidentally, water splashes, water contained in the intake air, and so on strike against the separator 107 as indicated by a solid line arrow W in FIG. 7, and thereby the water is separated from the air to then drop down onto the bottom portion 106*b* of the under plate 106. The bottom portion 106*b* of the under plate 106 is the inclined plane inclined forward and downward, so that the water flows down forward (namely, toward the side opposite to the throttle body 30). Then, the water that has flowed down reaches the vicinity of a boundary with the step portion 106*a* at the front of the bottom portion 106*b*.

The drain hole 112 is formed immediately close to the boundary with the step portion 106*a*, thereby letting the water flow down into the drain pipe 111 through the drain hole 112. Thereafter, the water passes through the drain pipe 111 through the drain hole 112 to be drained to the outside of the outboard motor 10 via the opening portion 110 in the lower cover 100B. That is, even though water and the like are taken in through the outside air intake port 102 tentatively, they are not sucked into a throttle body 30 side.

Then, the drain pipe ill is provided with the backflow prevention mechanism, so that the water that has flowed down through the drain pipe 111 is prevented from flowing back into the internal space of the intake chamber 105.

Next, an explanation related to the main constitution according to the embodiment of the present invention will be conducted. First, the outside air intake port 102 is provided on the upper cover 100A covering the top of the outboard motor 10, and the above outside air intake port 102 opens forward.

When the craft travels as described above, outside air flows in through the outside air intake port 102 provided in the bulging portion 101 of the upper cover 100A on top of the outboard motor 10. First, the outside air intake port 102 is open forward, so that it is possible to let traveling air flow in directly. Thus, intake efficiency is greatly improved. Conventionally, air has been taken in through an outside air intake port opening rearward as described previously, so that the intake efficiency has been forced to deteriorate. According to the embodiment of the present invention, it becomes possible to eliminate difficulty in sucking caused by physical reasons such as intake resistance, and to increase the intake efficiency and further engine output.

Further, the outside air intake port 102 is provided in the bulging portion 101 provided to bulge on the upper surface of the upper cover 100A. By making the bulging portion 101 bulge from the upper surface of the upper cover 100A, air flow to strike against the bulging portion 101 is received once, and in the outside air intake port 102, a stagnation-like state of the air is made. Outside the outside air intake port 102, or in the vicinity of the outer periphery of the outside air intake port 102, basically, air is not in such a stagnation-like state, and flow velocity of the air is relatively increased. Thus, water splashes and the like are drawn by outer air flow with high flow velocity to deviate from the outside air intake port 102. In terms of this point as well, an intrusion prevention effect of wave splashes and the like can be obtained. By making the outside air intake port 102 open forward in this manner, air is easily taken in, but water splashes and the like other than intake air are not allowed to get into the outside air intake port 102, resulting in that high intake performance can be achieved.

Further, by providing the outside air intake port 102 on the upper surface of the upper cover 100A covering the top of the outboard motor 10, the outside air intake port 102 is disposed at the highest position on the outboard motor 10. Obstacles to incoming air are reduced in front of the outside air intake port 102 disposed as above, and thus smooth incoming air flow into the outside air intake port 102 can be obtained. Further, by the outside air intake port 102 being disposed at a high place of the outboard motor 10, the outside air intake port 102 is disposed at a position much higher from the water surface, resulting in that intrusions of wave splashes and the like can be effectively prevented.

Incidentally, the outside air intake port 102, namely the bulging portion 101 can also be provided not on the top of the outboard motor 10 but on a side surface of the outboard motor 10. However, in the above case, the bulging portion 101 projects laterally of the outboard motor 10, so that if the bulging portion 101 is provided as above, a lateral width of the outboard motor 10 is increased. Thus, according to the embodiment of the present invention, for example, even in the case when a plurality of the outboard motors 10 are hung and mounted on a hull, in particular, or the like, hanging a plurality of the outboard motors 10 can be achieved effectively because the lateral width of the outboard motor 10 itself can be reduced.

Further, the step portion 104 is provided in front of the lower edge of the outside air intake port 102 on the upper surface of the upper cover 100A, In the above case, further, the upper surface of the upper cover 100A extending forward from the step portion 104 is formed into the inclined surface inclined forward and downward.

By providing the step portion 104, what is called a weir is formed against surface flows of wave splashes flowing on the upper surface of the upper cover 100A from the front of the outside air intake port 102, and it is possible to effectively prevent wave splashes and the like from directly getting into the outside air intake port 102, and a breakwater like effect is provided. Furthermore, the upper surface of the upper cover 100A extending forward from the outside air intake port 102 is inclined forward and downward, thereby, as illustrated in FIG. 7, making wave splashes and the like $W_1$ difficult to go up toward the outside air intake port 102, and it is possible to suppress that the wave splashes and the like $W_1$ come up on the upper surface of the upper cover 100A.

Further, the surrounding wall 101*a* extending forward is provided on the periphery of the outside air intake port 102. The outside air intake port 102 is disposed so as to be surrounded by the surrounding wall 101*a*, namely disposed at a position back in a duct-shaped form.

Providing the surrounding wall 101*a* as above allows outside air to be taken in at the back position, and this makes it possible to prevent wave splashes and the like from getting into the outside air intake port 102 directly.

As for the concrete shape of the surrounding wall 101*a*, typically, the inner surface is formed substantially linearly, and the outer surface is formed into an outward convex curved shape.

The surrounding wall 101*a* is formed to have such a cross-sectional shape, thereby making outer flow velocity of outside air fast and making inner flow velocity thereof slow relatively. Thus, wave splashes and the like are led by the outer flow with fast flow velocity to flow so as to deviate from the outside air intake port 102. Thus, it is possible to make wave splashes difficult to get into the outside air intake port 102. Further, the joined portions 101*c* and the projecting portion 101*d* are also formed to be convex outward, which contributes to making flow velocity of outside air fast similarly to the case of the surrounding wall 101*a*.

Furthermore, the joined portions 101*c* between the surrounding wall 101*a* and the upper surface of the upper cover 100A are extended forward.

By providing the joined portions 101*c*, in the entire form of the surrounding wall 101*a* including the above joined portions 101*c*, a lower portion of the form is extended more forward than an upper portion of the form. That is, one part of the surrounding wall 101*a* is enlarged or expanded, and thereby a shielding effect against wave splashes and the like can be further improved.

Here, a characteristic operation and effect of the intake device 4 of the outboard motor according to the embodiment of the present invention will be further explained. The intake device 4 of the outboard motor according to the embodiment of the present invention, in the space inside the upper cover 100A, namely in the intake chamber 105, supplies outside air taken in through the outside air intake port 102 to the throttle body 30 to get the outside air sucked. In the intake device 4, first, the intake chamber 105 being the space communicating with the outside air intake port 102 and the throttle body 30 is isolated from the engine room 1 by the under plate 106. Thus, the intake device 4 is disposed and constituted above the engine 14 with being isolated from the engine 14 in the engine room As described previously, air taken in through the outside air intake port 102 passes into the intake chamber 105, and as indicated by the dotted line arrow A in FIG. 7, passes through under the skirt portion 107*a* of the separator 107 to then be supplied to the throttle body 30 through the opening 108*a* of the guide base portion 108 and the upper end opening portion 26*a* of the throttle body coupling pipe 26. In this manner, combustion air passes through the airflow path in the space isolated from the engine room 1 to then be supplied to the throttle body 30, and thus the engine 14. That is, there is no case that on the way to the engine 14, combustion air is exposed to the high-temperature engine to be warmed up, so that filling efficiency of intake air is increased, and combustion efficiency and the like can be greatly improved.

Further, along the airflow path in the intake device 4, the separator 107 for liquid/gas separation is provided, and the separator 107 is provided with the skirt portion 107*a* formed by at least the front portion of the separator 107 being extended downward.

Intake air that has flowed into the intake chamber 105 through the outside air intake port 102 in the state illustrated in FIG. 7 flows toward the separator 107 at the rear. The skirt portion 107*a* extends downward, so that water contained in the intake air, and the like strike against the skirt portion 107*a*, and thereby gas/liquid separation is performed precisely.

In the above case, as illustrated in FIG. 7, a lower end 102A of the outside air intake port 102 is positioned higher than a lower end 107A of the skirt portion 107*a*. Intake air that flows straight toward the separator 107 through the outside air intake port 102 strikes against the skirt portion 107*a* without exception, so that the intake air does not flow directly into the opening 108*a* of the guide base portion 108, namely the throttle body 30. As for the outboard motor 10 of this type, in particular, while a craft is traveling, a trim angle is adjusted, namely a trim angle is increased, and thereby the entire outboard motor 10 is set in the forward tilting posture. At the time of the trim angle adjustment as above, an inflow angle of outside air with respect to the outside air intake port 102 also changes, and directivity to the opening 108*a* of the guide base portion 108 is more increased. In the above case, if the skirt portion 107*a* is not provided tentatively, intake air that has flowed in through the outside air intake port 102 sometimes flows directly toward the opening 108*a*. In the embodiment of the present invention, even in the case when the trim angle adjustment of the outboard motor 10 is performed as above, the skirt portion 107*a* can prevent intake air from directly flowing into the opening 108*a*, and thus the throttle body 30 because the skirt portion 107*a* is positioned between the outside air intake port 102 and the opening 108*a* of the guide base portion 108.

Further, as is clear also from FIG. 7, the lower end 107A of the skirt portion 107*a* of the separator 107 is positioned lower than the opening 108*a* of the guide base portion 108. Such a disposition structure of the skirt portion 107*a* combines with the above-described disposition relationship with the lower end 102A of the outside air intake port 102 to provide what is called a labyrinth effect to the air that has flowed in as indicated by the dotted line arrow A in FIG. 7. The air flows along a labyrinthian path, and thereby a gas/liquid separation effect can be further improved.

Further, the intake device 4 of the outboard motor according to the embodiment of the present invention, in the space inside the upper cover 100A, namely in the intake chamber 105, supplies outside air taken in through the outside air intake port 102 to the throttle body 30 to get the outside air sucked. In the intake device 4, first, the outside air intake port 102 opens forward as described previously. In the embodiment of the present invention, in particular, as illustrated in FIG. 7, the separator 107 is provided above the intake port 27 of the throttle body 30 so as to cover the intake port 27 of the throttle body 30. Concretely, the separator 107 is supported via the connecting rods 109 above the upper end opening portion 26*a* of the throttle body coupling pipe 26 connected to the intake port 27 of the throttle body 30. In the above case, as described previously, the rear portion side of the separator 107 is in close contact with the inner peripheral surface of the under plate 106.

Since the outside air intake port 102 is open forward, it is possible to let traveling air flow into the outside air intake port 102 directly, resulting in that the intake efficiency is improved greatly. In the above case, even though a large amount of water intrudes into the outside air intake port 102 tentatively, the water drops down onto an upper surface of the separator 107. Thus, the water does not directly get into the upper end opening portion 26*a* of the throttle body coupling pipe 26, namely the intake port 27 of the throttle body 30. That is, the separator 107 serves as a ceiling wall of the intake port 27 of the throttle body 30, and functions as a shielding plate against the water that has intruded. Thus, a high water intrusion prevention effect can be obtained. Incidentally, since the rear portion side of the separator 107 comes into close contact with the inner peripheral surface of the under plate 106, the water does not get in between the rear portion side of the separator 107 and the inner peripheral surface of the under plate 106.

The water that has intruded into the inside of the intake chamber 105 is immediately drained to the outside of the intake chamber 105 through the drain pipe 111 serving as the drain path. Concretely, the bottom portion 106*b* of the under plate 106 is the inclined plane inclined forward and downward, and the drain hole 112 (=the end portion, of the drain path, on the inside side of the intake chamber 105) is provided at the lowest portion of the bottom portion 106*b*. Thus, the water that has intruded into the inside of the intake chamber 105 flows down forward on the bottom portion 106*b* to then be drained to the outside of the intake chamber 105 through the drain pipe 111 serving as the drain path. Thus, it is possible to prevent that the water that has intruded into the inside of the intake chamber 105 flows into the intake port 27 of the throttle body 30 through the upper end opening portion 26*a* of the guide base portion 108. Particularly, the upper end opening portion 26*a* of the guide base portion 108 is provided near the rear of the intake chamber 105, so that the water that has intruded into the inside of the intake chamber 105 flows down away from the intake port of the throttle body 30. Thus, it is possible to prevent that the water that has intruded into the inside of the intake chamber 105 flows toward the intake port 27 of the throttle body 30, and stays in the vicinity of the intake port 27 of the throttle body 30. Accordingly, it is possible to prevent the water from intruding into the intake port 27 of the throttle body 30.

The drain hole 112 is provided so as to be always positioned at the lowest portion of the bottom portion 106*b* even in the case when tilt up of the outboard motor 10 is performed. Thus, it is possible to immediately drain the water that has intruded into the inside of the intake chamber 105, regardless of the posture of the outboard motor 10.

Then, the drain path is provided with a check mechanism, so that it is possible to prevent the water from intruding into the inside of the intake chamber 105 through the drain path. Further, it is possible to prevent that the water once drained through the drain path flows back to then return to the inside of the expansion chamber 105.

Further, the throttle body 30 is disposed rearward apart from the outside air intake port 102. That is, the outside air intake port 102 is disposed near the front on the upper cover 100A, in contrast to this, the throttle body 30, and thus the throttle body coupling pipe 26 is disposed near the rear of the engine room 1.

A long separation distance between the throttle body 30 and the outside air intake port 102 is secured as above. Thus, the airflow path of intake air is lengthened according to the separation distance, thereby facilitating the separation of water contained in the intake air. In terms of this point as well, the intrusion of water into the throttle body 30 side can be effectively prevented.

Further, the longer the separation distance between the throttle body 30 and the outside air intake port 102 becomes, the more the capacity of the intake chamber 105 is increased. This makes it possible to improve the filling efficiency of intake air.

Furthermore, the outside air intake port 102 is provided in the bulging portion 101 provided to bulge on the upper surface of the upper cover 100A covering the top of the outboard motor 10, and a rear end 101A of the bulging portion 101 (see FIG. 5, FIG. 7, and the like) is positioned between the front end 107A and a rear end 1078 of the separator 107.

A positional relationship of the separator 107 to the bulging portion 101 is set in this manner, and thereby even in the case when a large amount of water intrudes into the outside air intake port 102 similarly to the above case, it is possible to let the water drop down onto the upper surface of the separator 107 securely.

For example, in the case when the rear end 101A of the bulging portion 101 is positioned more forward than the front end 107A of the separator 107, namely the rear end 101A of the bulging portion 101 is not positioned above the separator 107 tentatively, a large amount of water that has intruded into the outside air intake port 102 sometimes drops down onto the bottom portion 106*b* of the under plate 106 directly. In the case when the water drops down as above, it is assumed that splashes of the water get into the upper end opening portion 26*a* of the throttle body coupling pipe 26 directly. In the embodiment of the present invention, since the rear end 101A of the bulging portion 101 is positioned above the separator 107, such a problem is not caused.

In the foregoing, the present invention has been explained with the embodiment, but the present invention is not limited to this embodiment, and changes and the like may be made within the scope of the present invention.

In the above-described embodiment, an example where the single bulging portion 101 and the single outside air intake port 102 are provided has been explained, but it is also possible to provide two or more of the outside air intake ports 102 formed similarly.

According to the present invention, combustion air is supplied to the throttle body and thus the engine through the airflow path in the space isolated from the engine room. That is, the combustion air is not warmed up by the high-temperature engine on the way to the engine, so that the filling efficiency of intake air is increased and the combustion efficiency and the like can be improved greatly. Further, on the extension of an inflow direction of intake air that has flowed into the intake chamber through the outside air intake port, the separator is disposed, and the skirt portion is extended downward. Thereby, water contained in the intake air, and the like strike against the skirt portion, and thereby gas/liquid separation is performed precisely.

Further, according to the present invention, the outside air intake port opens forward, so that it is possible to let traveling air flow into the outside air intake port directly, and the intake efficiency is improved greatly. Then, even though a large amount of water intrudes into the outside air intake port, the water can be drained to the outside of the outboard motor through the drain path. Thus, it is possible to prevent the water that has intruded from getting into the intake port of the throttle body.

Accordingly, the high water intrusion prevention effect can be obtained.

It should be noted that the above embodiments merely illustrate concrete examples of implementing the present invention, and the technical scope of the present invention is not to be construed in a restrictive manner by these embodiments. That is, the present invention may be implemented in various forms without departing from the technical spirit or main features thereof.

What is claimed is:

1. An intake device of an outboard motor including: an engine; an engine cover covering the engine; and an engine compartment formed inside the engine cover, the intake device of the outboard motor comprising:

an upper cover attached to an upper surface of the engine cover;

an outside air intake port formed in the upper cover and opening in a direction to a forward traveling direction of the outboard motor;

a throttle body through which outside air taken in through the outside air intake port is supplied to the engine;

an intake chamber formed between the upper cover and the engine cover and communicating with the outside air intake port and an upstream end of the throttle body, the intake chamber being isolated from the engine compartment; and a separator provided inside the intake chamber and separating from each other gas and liquid in the outside air taken in through the outside air intake port, wherein the separator includes a skirt portion formed by at least a front portion of the separator being extended downward, the separator covers an intake port of the throttle body from above, and an upper end portion of the outside air intake port formed in the upper cover is provided to be positioned higher than the separator.

2. The intake device of the outboard motor according to claim 1, wherein a lower end of the skirt portion is disposed lower than an intake communication port of the throttle body.

3. The intake device of the outboard motor according to claim 2, wherein a lower end of the outside air intake port is disposed higher than a lower end of the skirt portion.

4. The intake device of the outboard motor according to claim 3, further comprising:

a plate isolating the intake chamber from the engine compartment, wherein the intake chamber is isolated from the engine compartment by the plate.

5. An intake device of an outboard motor including: an engine; an engine cover covering the engine; and an engine compartment formed inside the engine cover, the intake device of the outboard motor comprising:

an upper cover attached to an upper surface of the engine cover and including an outside air intake port;

a plate lying between the engine cover and the upper cover;

an intake chamber formed between the upper cover and the plate and isolated from the engine compartment;

a throttle body through which outside air taken into the intake chamber through the outside air intake port is supplied to the engine;

a drain path that communicates with an internal space and external space of the intake chamber and through which water that has intruded into the internal space of the intake chamber is allowed to be drained to the external space of the intake chamber, wherein the plate is provided with a bottom wall including an upper area and a lower area, and a throttle body coupling pipe through which outside air taken into the intake chamber is supplied to the throttle body communicates with the upper area of the bottom wall, and the drain path communicates with the lower area of the bottom wall.

6. The intake device of the outboard motor according to claim 5, wherein the drain path communicates with the lower area of the bottom wall positioned at a lowest portion of the intake chamber in a state where tilt up of the outboard motor is performed and is not performed.

7. The intake device of the outboard motor according to claim 5, wherein the drain path is provided with a backflow prevention mechanism preventing water from flowing back into the internal space of the intake chamber from the external space of the intake chamber.

8. The intake device of the outboard motor according to claim 7, wherein the backflow prevention mechanism is a one-way valve.

9. The intake device of the outboard motor according to claim 7, wherein the backflow prevention mechanism is an S-shaped pipe.

* * * * *